US005601131A

United States Patent [19]

Morris

[11] Patent Number: 5,601,131

[45] Date of Patent: Feb. 11, 1997

[54] CANOPY-FORMING DOOR

[76] Inventor: Drew W. Morris, P.O. Box 10111, Greenville, S.C. 29603

[21] Appl. No.: 582,216

[22] Filed: Jan. 2, 1996

[51] Int. Cl.[6] ..... E05D 15/26

[52] U.S. Cl. ..... 160/207; 160/213

[58] Field of Search ..... 160/207, 213, 160/201, 206, 210, 203, 88; 49/13, 14

[56] References Cited

U.S. PATENT DOCUMENTS

| | | | |
|---|---|---|---|
| 2,155,116 | 4/1939 | Cox | 160/207 X |
| 3,504,729 | 4/1970 | Alton | 160/207 |
| 3,635,278 | 1/1972 | Bocade . | |
| 4,084,347 | 4/1978 | Brown . | |
| 4,088,172 | 5/1978 | Pollock | 160/207 X |
| 4,261,409 | 4/1981 | De Vore | 160/207 |
| 4,284,980 | 8/1981 | Hoinski | 49/13 X |
| 4,405,008 | 9/1983 | Hazlett . | |
| 4,448,232 | 5/1984 | McQueen et al. | 160/207 |
| 4,637,446 | 1/1987 | McQueen et al. | 160/207 |

*Primary Examiner*—David M. Purol
*Attorney, Agent, or Firm*—Hardaway Law Firm, P.A.

[57] ABSTRACT

An upwardly-opening door requiring limited space during opening and closing, the door being made of two panels with the second panel being hinged to the first panel and the first panel being hinged to side walls, the second panel also being guided in tracks mounted to the side walls, such that upon opening of the door the two panels form a canopy over the door opening. In a preferred embodiment, when the door is opened, the second panel is in a horizontal position.

6 Claims, 2 Drawing Sheets

CANOPY-FORMING DOOR

BACKGROUND OF THE INVENTION

This invention relates generally to a door, and more particularly to an upwardly-acting garage door that forms a canopy over a door opening when the door is in opened position.

A canopy-forming door is desirable for protecting the door opening against sunlight, rain, and snow. Such an arrangement finds use when installed, for example, as a ramp door where trucks are loaded and unloaded or as a garage door providing a sheltered working area on the driveway in front of the garage.

U.S. Pat. No. 4,405,008 discloses an adjustable heat shield made of two panels with one panel being hinged to and hanging from the other panel such that the panels cover the area of a window when hanging down straight. Using several ropes, one rope system for each panel, the two panels can be moved upward and can be adjusted to any position, thus forming an adjustable shield over the window. This heat shield, however, is not designed for use as a garage door nor for a canopy. Its rope mechanism is rather complicated and not designed to withstand extreme weather conditions such as to carry snow loads. An additional canopy for protection is provided and located above the heat shield.

U.S. Pat. No. 3,635,278, directed to a collapsible barrier member, discloses a system of horizontal panels hinged together by flexible plastic ribs, the panels having pins at their ends for being guided in vertical tracks such that the panels can be straightened by moving the uppermost panel. This apparatus, of course, is different from a garage door but could be used as such. However, it does not form a canopy in a folded position. Even if made from only two panels, thus forming a shelter over a door opening, that apparatus would be too weak for withstanding severe weather conditions. Strong and heavy weight garage doors demand different constructions.

While the devices within the prior art function well for their intended purposes, room for improvement exists.

SUMMARY OF THE INVENTION

It is thus an object of the invention to provide a garage door that requires little space when it is opening and when it is in opened position.

It is another object to provide a door which, when open, forms a canopy over the door opening for providing an area protected against sunlight, rain and snow.

It is a further object to provide a canopy-forming door wherein the formed canopy withstands wind, rain and snow loads.

It is a still further object to provide the a canopy-forming door arrangement using a simple and inexpensive construction.

These as well as other objects are accomplished by a door, when in closed position, covering an opening defined by a structure including a side wall, comprising a first panel hinged to the structure, a second panel hinged to the first panel, a guiding member communicating with a side of the second panel, and a track mounted to the side wall and accommodating the guiding member, whereby upon upwardly moving of the first or second panel, the first panel and second panel form a canopy over the door opening.

Other objects and a fuller understanding of the invention will become apparent from the following description given with reference to the various figures of drawing.

DETAILED DESCRIPTION

In accordance with this invention it has been found that a novel door is provided which forms a strong canopy over the door opening when the door is in opened position.

Figure 1:
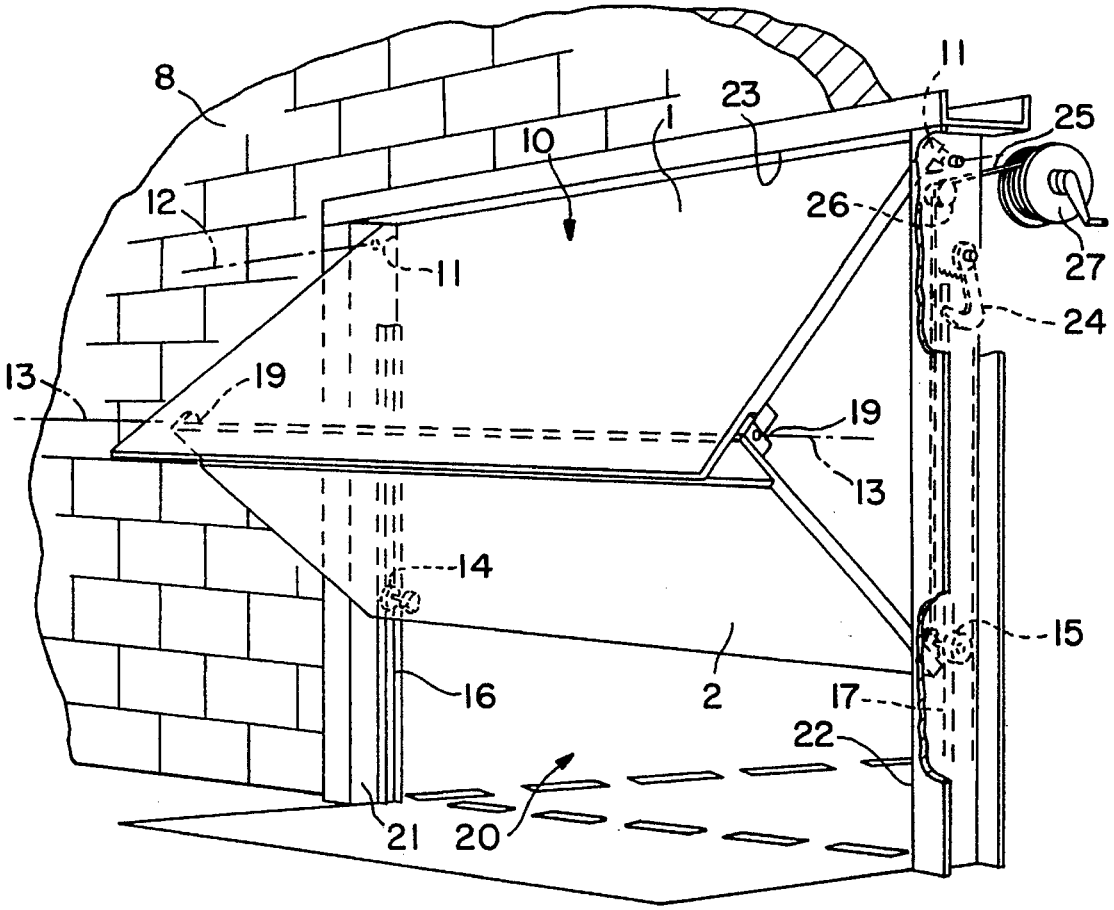
FIG. 1 is a perspective view of a canopy-forming door constructed in accordance with a preferred embodiment of the present invention, the door shown as assuming a partially open position.

FIG. 1 shows a perspective view of a door 10 according to the present invention. A door opening 20 in a structure 8 is defined by side walls 21, 22 and by a top wall 23. A first panel 1 is hingedly mounted to the side walls 21,22 at hinges 11 or, alternatively, to top wall 23 so that first panel 1 can swing around a horizontal axis 12 passing through hinges 11. A second panel 2 is hinged with hinges 19 to first panel 1 having an axis 13 parallel to axis 12. Both panels together cover door opening 20 when hanging down straight in a closed position. As is evident from FIG. 1, first panel 1 and second panel 2 will overlap when door 10 is in a closed position. Tracks 16,17 are mounted to side walls 21,22 of door opening 20 preferably in a vertical manner. Second panel 2 has guiding members, preferably in the form of pins 14,15, on each side which are guided in tracks 16,17. Upon opening door 10, panel 1 and panel 2 are forced to swing upwardly with pins 14,15 of panel 2 sliding in tracks 16,17 so that panel 1 and panel 2 are at an angle to one another.

Figure 2:
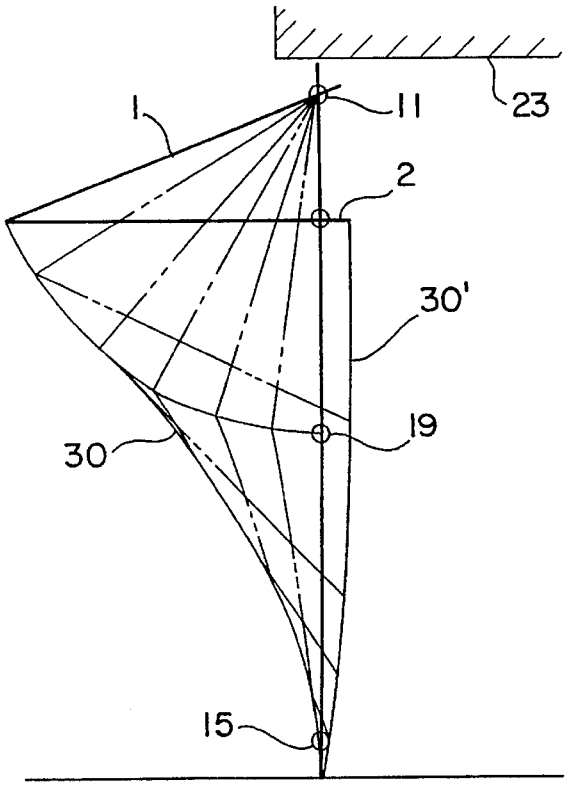
FIG. 2 is a side elevation view of the canopy-forming door shown in FIG. 1, illustrating the lines of travel of the outward and inward extremities of the door as the canopy forming door is moved from a closed position to an opened position.

FIG. 2 shows door 10 in fully opened position. First panel 1 is seen to extend horizontally beyond second panel 2 when door 10 is in an open position. Curve 30 indicates the line of travel the outward extremities of door 10 as it is moved from an opened position to a closed position, and curve 30' indicates the line of travel of the inner extremities of panel 2 between these positions. It is thus seen that the present invention provides a door requiring only little space for opening and closing. A door according to this invention is especially advantageous when used as a garage door, because it allows for stopping a car close to the garage prior to opening the garage door.

A specific embodiment of the invention could comprise panel 2 being hinged to the lower side of panel 1 and locking pins 14,15 being mounted to the lower edges of second panel 2.

Figure 3:
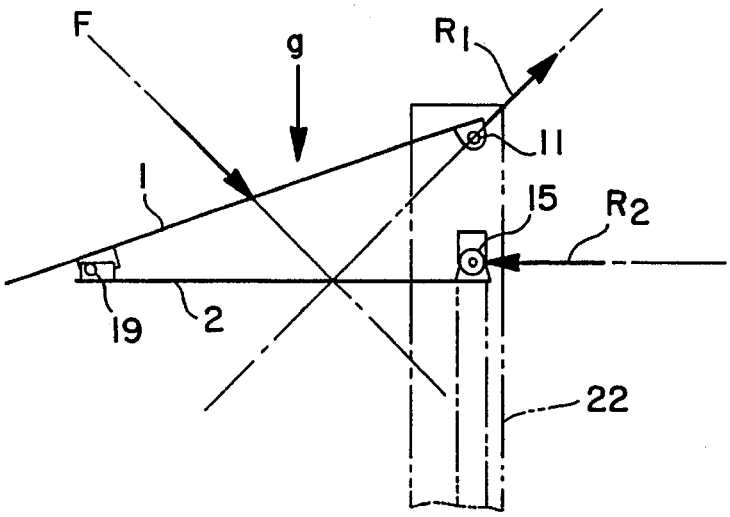
FIG. 3 is a line diagram of forces acting upon a canopy-forming door constructed in accordance with a preferred embodiment of the present invention.

FIG. 3 shows a line diagram of door 10 in the fully opened position, looking toward side wall 22, with panel 1 having a slope and panel 2 being perpendicular to the side walls. As will be seen by someone skilled in the art, with this configuration no force is causing the door to move down other than the weight of panel 2. For easier understanding of the physics, this configuration is schematically shown as a two-dimensional system of forces acting in a vertical plane. The system is fully described by the direction of gravitation g, an acting force F generated on panel 1, a first resultant force R1 taken by hinge 11, and a second resultant force R2 generated via pin 15 into side wall 22. The weight of panel 2 is neglected. Hinge 11 and pin 15 are unable to transfer moments; thus, the sum of moments at these points must be zero at equilibrium. As can easily be seen, panel 2 behaves like a pressure beam because only two forces act on it: first, resultant force R2 and, second, an internal force at hinge 19 transferred from panel 1 via hinges 19 into panel 2. Thus, the direction of resultant force R2 must follow the direction of panel 2. A panel 2 in horizontal position would therefore transfer forces from panel 1 via pin 15 into wall 22 with no vertical component. Therefore, regardless any force acting on top of the canopy, only little force—according to the weight of panel 2—is necessary to hold door 10 in open position. A relatively small locking pin or hook 24 or any similar device would be suitable.

Furthermore, a canopy according to this invention, made of two panels connected to each other and each panel being linked to the wall structure, possesses more stiffness than a canopy made of only one panel, therefore being capable of withstanding strong winds. The enhanced stiffness results from the specific arrangement since a distortion of one panel can not be obtained without distorting the other panel as well. Hooks 24 support such properties.

In a preferred embodiment the opening of door 10 is performed by using a rope 25 connected to panel 2, the rope being led over a pulley 26 or over hinge 11, and turned onto a drum 27. Preferably, two ropes 25 are employed, one of each attached to each of pins 14 and 15, with ropes 25 running through tracks 16,17 and being turned onto a single drum 27. The drum can be driven manually or remote controlled employing any suitable power drive. This arrangement allows for hold of door 10 in any position by preventing the drum from further rotation. An additional hook 24 on the side walls of door opening 20 for holding door 10 in position becomes unimportant. However, a further fixation of pins 14,15, for example, with hook 24 would additionally strengthen the canopy.

Figure 4:
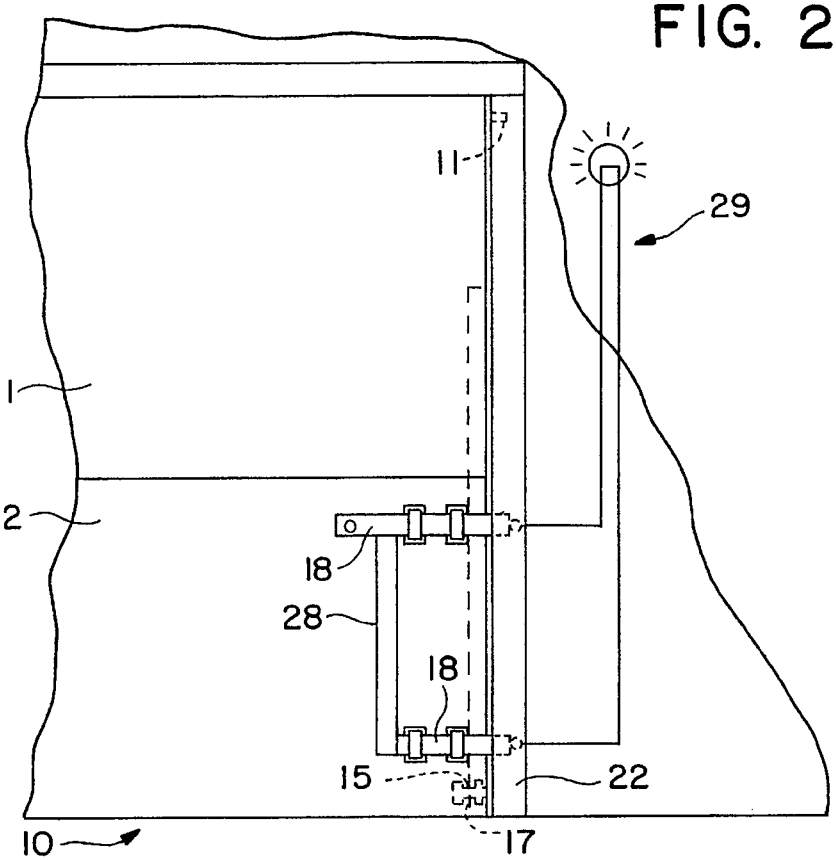
FIG. 4 is a fragmented front view of a canopy forming door according to the present invention showing a lock arrangement.

Door 10 might be locked using any device that fixes one of panels 1,2 to walls 21 or 22 of door opening 20. FIG. 4 shows a preferred embodiment providing a vertical bar 28 which is attached to panel 2 via link members 18 communicating with bar 28 and pivotally secured to side wall 22. Of course, other locking devices that, for example, fix panel 2 to the ground or prevent panels 1 and 2 from forming an angle by placing vertical bar 28 across hinges 19 from the inside or outside of door 10, would also be suitable.

In a further preferred embodiment, also shown in FIG. 4, the securing of bar 28 to side wall 22 is designed to complete a circuit to an alarm system 29.

As many variations will become apparent to those skilled in the art, such variations are embodied within the spirit and scope of this invention as measured by the following claims.

That which is claimed:

1. A door for covering an opening when in a closed position, said opening being defined by a structure having a first side wall, said door comprising:

a first panel hinged to said structure;

a second panel hinged to said first panel;

said first and second panels overlapping when said door is in said closed position;

said first panel extending horizontally beyond said second panel when said door is in an opened position;

a first guiding member communicating with a side of said second panel; and a first track mounted to said first side wall accommodating said first guiding member, whereby upon upwardly moving said first panel or said second panel, said first panel and said second panel form a canopy over said door opening.

2. The canopy-forming door according to claim 1 wherein said canopy is formed by said first panel having a slope and said second panel being perpendicular to said side wall.

3. The canopy forming door according to claim 1 including a hook attached to said first side wall for fixing the canopy in predetermined positions.

4. The canopy forming door according to claim 1 including a rope system for opening said door comprising:

a rope attached to said second panel; and a drum for winding said rope.

5. The canopy forming door according to claim 1 including:

a second guiding member communicating with another side of said second panel; and a second track accommodating said second guiding member;

said second track mounted to a second side wall of said structure with said second side wall being opposed to said first side wall.

6. The canopy forming door according to claim 5 including a rope system for opening said door comprising:

a first rope attached to said first guiding member;

a second rope attached to said second guiding member; and a drum for winding up said first and said second rope;

said first and second ropes being located in said tracks.

* * * * *